US005706669A

United States Patent [19]

Lee

[11] Patent Number: 5,706,669

[45] Date of Patent: Jan. 13, 1998

[54] DEFROST-WATER VAPORIZER FOR A REFRIGERATOR

[75] Inventor: Yong-Kweon Lee, Incheon, Rep. of Korea

[73] Assignee: Daewoo Electronics Co., Ltd., Seoul, Rep. of Korea

[21] Appl. No.: 671,295

[22] Filed: Jul. 1, 1996

[30] Foreign Application Priority Data

Jun. 30, 1996 [KR] Rep. of Korea ..... 95-18835

[51] Int. Cl.[6] ..... F25D 21/14

[52] U.S. Cl. ..... 62/281; 261/80

[58] Field of Search ..... 62/281, 314; 261/80

[56] References Cited

U.S. PATENT DOCUMENTS

| | | | |
|---|---|---|---|
| 1,817,442 | 4/1931 | Martin, Jr. | 261/80 |
| 2,883,837 | 4/1959 | Rose | 261/80 |
| 3,856,279 | 12/1974 | Yeagle | 261/80 |
| 4,237,080 | 12/1980 | Elliott | 261/80 |
| 4,520,864 | 6/1985 | Katagiri et al. | 261/80 |
| 4,876,861 | 10/1989 | Tanaka et al. | 62/281 |
| 5,271,241 | 12/1993 | Kim | 62/281 |

*Primary Examiner*—William E. Tapolcai
*Attorney, Agent, or Firm*—Lowe, Price, LeBlanc & Becker

[57] ABSTRACT

Disclosed is a defrost-water vaporizer for a refrigerator capable of vaporizing defrost-water in a short time. The defrost-water vaporizer includes a defrost-water absorption portion disposed between a pair of brackets and for absorbing and transmitting the defrost-water and a blow-off portion for generating rotating force from electric power and sending blowing air to the defrost-water absorption portion. The absorbed defrost-water is rapidly vaporized by the blow-off portion, and accordingly the vaporization efficiency is enhanced.

4 Claims, 2 Drawing Sheets

DEFROST-WATER VAPORIZER FOR A REFRIGERATOR

BACKGROUND OF THE INVENTION

1. Field of the Invention

The present invention relates to a refrigerator, and more particularly to a defrost-water vaporizer for a refrigerator capable of rapidly vaporizing defrost-water.

2. Prior Arts

FIG. 1 is a schematic view of a conventional refrigerator.

As shown in FIG. 1, a general household refrigerator includes a cabinet 1, a freezing compartment 2, a storage compartment 3 and vegetable compartment 4. The temperature in storage compartment 3 is higher than that in freezing compartment 2 and lower than that in vegetable compartment 4.

Reference numeral 5 indicates a vaporizer installed at the rear of freezing compartment 2 and reference numeral 6 indicates a fan for supplying freezing compartment 2 and storage compartment 3 with cool air. Reference numeral 7 is a machine compartment installed at the lower bottom part of cabinet 1, a defrost-water vaporizer 8 for vaporizing defrost-water is provided within machine compartment 7.

Generally, cool air is generated in a refrigerator by absorbing surrounding heat while a liquid-state refrigerant compressed in a compressor (not shown) is being vaporized. Fan 6 circulates the cool air in freezing compartment 2 and storage compartment 3 and thereby air in freezing compartment 2 and storage compartment 3 is cooled. At this time, the temperature difference between the cool air in freezing compartment 2 and storage compartment 3 and the air in evaporator 5 creates defrost-water.

The defrost-water flows together to a water-vaporization tray (not shown) of vaporizer 8 installed at the lower part of machine compartment 7 through a defrost-water bucket of vaporizer 5 and a pipe (not shown).

Conventionally three kinds of vaporizers are used for a refrigerator. One is to spontaneously vaporize defrost-water by enlarging the area of the water-vaporization tray. The other is to vaporize defrost-water by means of the high temperature heat of refrigerant passing through a condenser pipe installed at the lower part of the water-vaporization tray. And the third vaporizer vaporizes defrost-water by way of the high temperature heat of a compressor installed at the lower part of the water-vaporization tray.

At this time, the first vaporizer lacks the vaporizing efficiency. If the humidity is high outside or if much defrost-water is generated, the defrost-water overflows since it is not fully vaporized.

The second vaporizer takes advantage of the high heat of refrigerant passing through the condenser pipe which is installed at the lower part of the water-vaporization tray to connect the compressor with the vaporizer. The second vaporizer has greater efficiency in vaporizing the defrost-water than in the first vaporizer. However, since the condenser pipe is additionally installed at the lower part of the water-vaporization tray, the assembling process of a product is lengthened so that additional cost is involved.

According to the last vaporizer in which the water-vaporization tray is installed at the upper part of the compressor, space inside the machine compartment is available because the size of the water-vaporization tray is reduced, however, it is still a problem to reduce the efficiency of vaporizing defrost-water.

SUMMARY OF THE INVENTION

Therefore, it is an object of the present invention to provide a vaporizer for a refrigerator capable of vaporizing defrost-water in a short time.

Further, another object of the present invention is to provide a vaporizer for a refrigerator capable of making the most efficient use of the space in a machine compartment and storage compartment.

In order to achieve the above objects, a vaporizer for a refrigerator is preferably embodied according to the present invention. The vaporizer comprises a water-vaporization tray integrally formed with a pair of brackets, the brackets being set up on the opposite sides of the tray in an upper direction, and for collecting and containing defrost-water; a defrost-water absorption means disposed between and supported by the pair of brackets and for absorbing and moving the defrost-water; a blow-off means for generating blowing air to send it to the defrost-water absorption means by way of rotating force obtained from an alternating power source supplied from outside; and a power transmission means for transmitting the rotating force to the defrost-water absorption means to thereby move the defrost-water.

More particularly, a blower rotates according to a motor and a rotating shaft being rotated. At the same time, the rotating force of the motor and the rotating shaft is supplied to an upper roller and a lower roller of the defrost-water absorption means through the power transmission means and thereby the upper and the lower rollers are rotated. According to the rotation of the rollers, the defrost-water on the water-vaporization tray is suctioned into a vaporization belt and the suctioned defrost-water is vaporized by the blower. Therefore, it is possible to vaporize defrost-water quickly, and good vaporization efficiency is obtained.

BRIEF DESCRIPTION OF THE DRAWINGS

The objects and other advantages of the present invention will be apparently understood with reference to the accompanying drawings, in which.

DETAILED DESCRIPTION OF THE PREFERRED EMBODIMENT

Hereinafter, the preferred embodiment of the present invention will be described in greater detail by referring to the attached drawings.

Figure 1:
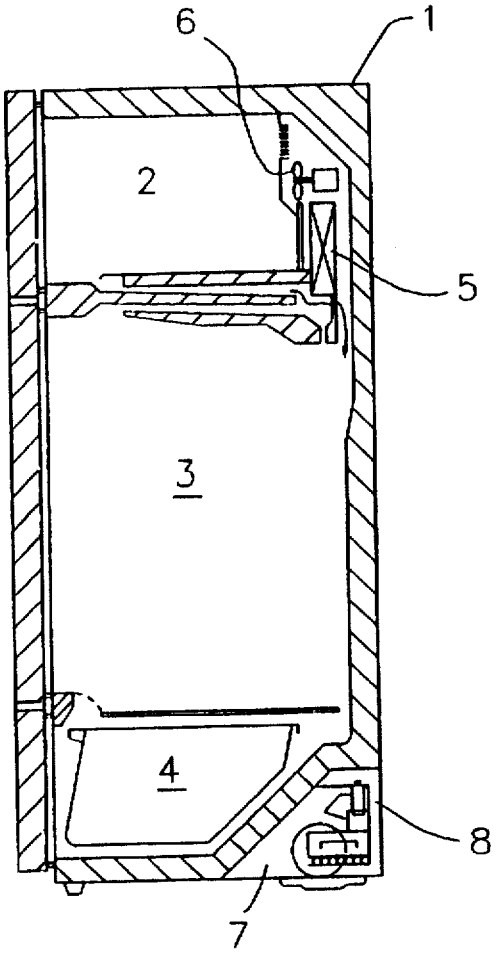
FIG. 1 PRIOR ART
FIG. 1 is a schematic view of a prior art refrigerator.
Figure 2:
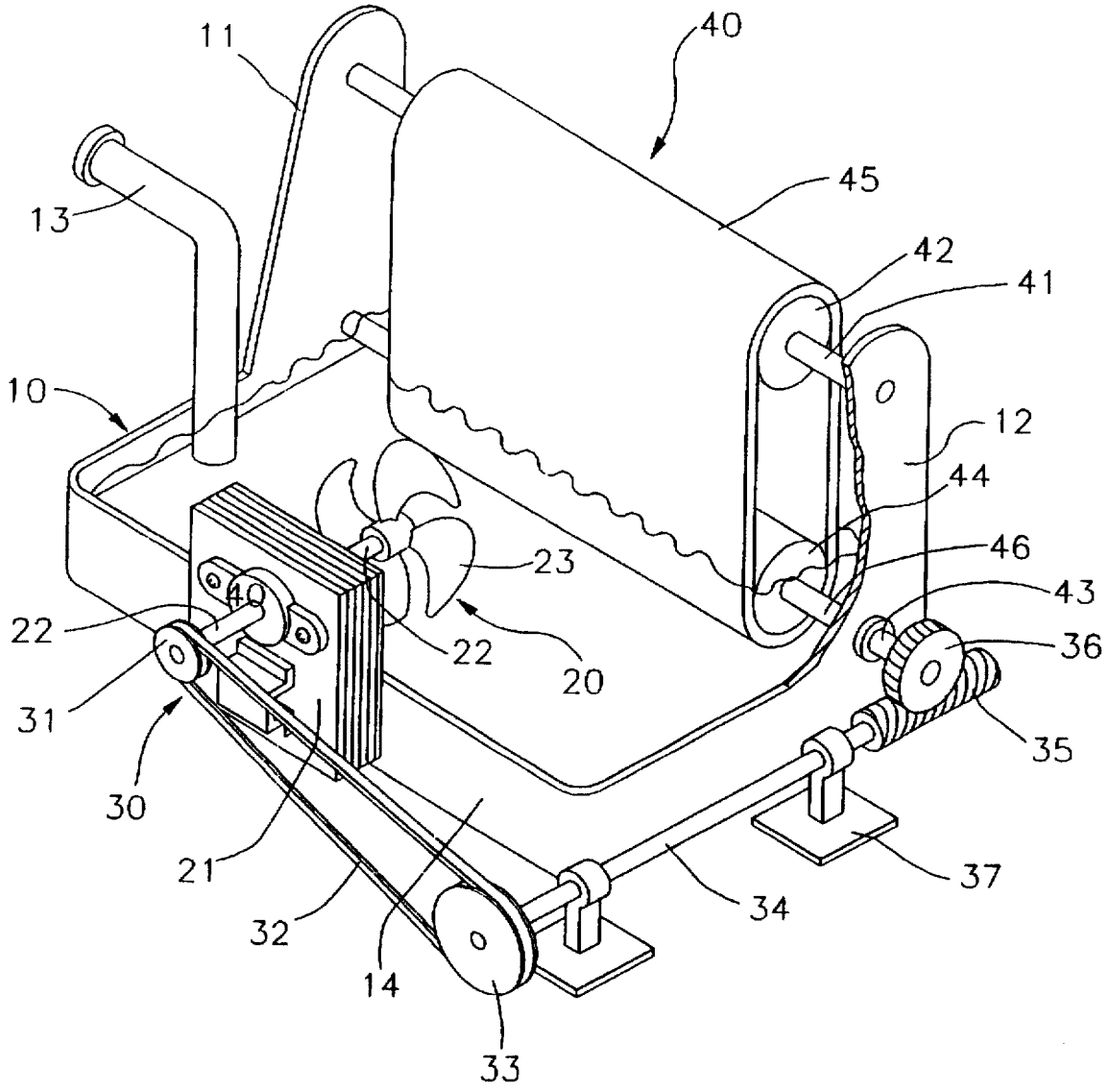
FIG. 2 is a detail view of a defrost-water vaporizer for a refrigerator according to the present invention.

FIG. 2 is a detail view of a defrost-water vaporizer for a refrigerator according to the present invention. As shown in FIG. 2, the defrost-water vaporizer comprises a water-vaporization tray 10, a blower 20, a driving force transmission portion 30, and defrost-water absorption portion 40. Water-vaporization tray 10 includes a box-shaped water tray part 14 and a pair of brackets 11 and 12 integrally formed with both opposite sides of water tray part 14. A pair of brackets 11 and 12 are formed in an upper direction from water tray part 14 and disposed at the rear side of water tray part 14. The defrost-water is concentrated at water tray part 14 of water-vaporization tray 10 through a pipe 13.

Blower 20 is installed at the front part of water-vaporization tray 10. Blower 20 generates rotating force from a power source outside and at the same time causes blowing air. Blower 20 includes a motor 21, a rotating shaft 22 and a fan 23. Motor 21 creates rotating force by receipt of the power source from outside. The generated rotating force is transmitted to rotating shaft 22 to thereby rotate rotating shaft 22. According to the rotation of rotating shaft 22, fan 23 causes blowing air while being rotated. Fan 23 is axially connected with rotating shaft 22 and makes a rotation as rotating shaft 22 rotates. Motor 21 is provided at the front part of water-vaporization tray 10. Rotating shaft 22 connected with motor 21 is installed in parallel with the bottom of water tray part 14. Rotating shaft 22 passing through motor 21 is projected in both forward and backward directions of motor 21.

Driving force transmission portion 30 includes a driving pulley 31 for transmitting rotating force of rotating shaft 22, a driven pulley 33 for receiving the rotating force transmitted from rotating shaft 22, a pulley belt 32 for connecting driving pulley 31 and driven pulley 33 to transmit the rotating force of driving pulley 31 to driven pulley 33, a gear shaft 34 axially connected with driven pulley 33, a driving gear 35 formed at the end of gear shaft 34 and for rotating according to the rotation of driven pulley 33, and a driven gear 36 meshed with driving gear 35 and for reversing the rotating direction of driving gear 35. At this time, since the diameter of driven pulley 33 is larger than that of driving pulley 31, the rotating speed of driven pulley 33 is reduced. A pair of shaft supports 37 are provided to support gear shaft 34.

Driven gear 36 is meshed with driving gear 35 at a right angle to each other, and a helical gear or a bevel gear is normally used for driven gear 36.

Between a pair of brackets 11 and 12, defrost-water absorption portion 40 for rotating while absorbing defrost-water is connected to the shaft of driven gear 36.

Defrost-water absorption portion 40 moves the defrost-water contained in water tray part 14 while rotating according to the shaft of driven gear 36 being rotated.

Specifically, between the upper parts of a pair of brackets 11 and 12, upper roller 42 is provided with an upper roller shaft 41 being installed at the center thereof. Both ends of upper roller 41 are rotatably connected to the pair of brackets 11 and 12 respectively.

Lower roller 44 is provided below upper roller 42 with a certain spacing. At the center of lower roller 44 a lower roller shaft 46 is provided. Both ends of lower roller 46 are rotatably connected with each of brackets 11 and 12. A part of lower roller 44 is submerged in the defrost-water contained in water tray part 14.

Each of the ends of lower roller shaft 43 is installed protrudingly in an outer direction from each of brackets 11 and 12. At one end of lower roller shaft 43 driven gear 36 is fixed. Thus, the rotation of driven gear 36 makes lower roller 44 rotating.

Around upper roller 42 and lower roller 44, a vaporization belt 45 is rolled. Accordingly, as lower roller 44 rotates, the rotation is transmitted to upper roller 42 by means of vaporization belt 45. Thus, when upper roller 42 is rotated according to the rotation of lower roller 44, vaporization belt 45 submerged in the water is moved upward. As vaporization belt 45 goes through lower roller 44, vaporization belt 45 absorbs the defrost-water in water-vaporization tray 10. The absorbed defrost-water moves from lower roller 44 to upper roller 42 with vaporization belt 45. At this time, vaporization belt 45 is formed broadly to the extent that lower roller 44 and upper roller 45 are fully covered.

According to the embodiment of the present invention described in the foregoing, the defrost-water vaporizer operates as follows.

From an inputted alternating power source, motor 21 is operated. The rotation of motor 21 makes driving pulley 31 of driving force transmission portion 30 rotate through rotating shaft 22.

The rotation of driving pulley 31 is applied to driven pulley 33 through pulley belt 32 and driven pulley 33 is rotated. The rotating speed of driven pulley 33 is reduced more than that of driving pulley 31 since driving pulley 31 has a smaller diameter than driven pulley 33.

By the rotation of driven pulley 33 being applied to driving gear 35 via gear shaft 34, driving gear 35 is rotated. The rotation of driving gear 35 applied to driven gear 36 rotates driven gear 36.

At this time, since driving gear 35 is meshed with driven gear 36 at a right angle, their rotations are also made perpendicularly.

Lower roller 44 is rotated by the rotation of driven gear 36 being applied to lower roller 44 through lower roller shaft 46. The rotation of lower roller 44 rotates upper roller 42 through vaporization belt 45. Vaporization belt 45 is rotated according to the rotation of lower roller 44 and upper roller 42.

As described in the foregoing, vaporization belt 45 revolves being submerged into defrost-water (shown as a wave form in FIG. 2). When vaporization belt 45 is submerged into the defrost-water, it absorbs defrost-water. Vaporization belt 45 that has absorbed defrost-water is moved upward from the defrost-water in water-vaporization tray 10.

Meanwhile, the rotation of motor 21 is transmitted to fan 23 through rotating shaft 22 to rotate fan 23. Fan 23 supplies blowing air toward vaporization belt 45 to thereby vaporize defrost-water absorbed by vaporization belt 45.

In the defrost-water vaporizer according to the above embodiment of the present invention, the defrost-water absorbed n vaporization belt 45 is vaporized by means of blower 20, thus the vaporization is performed in a very short time. Also, since the size of water-vaporization tray can be minimized, it is possible to obtain a smaller machine compartment and a comparatively larger freezing and storage compartments in a refrigerator.

The present invention was described by referring to an embodiment so far, however, it is possible to make modifications and changes of the present invention without diverging from the spirit of the invention. For example, natural blowing air may be used instead of the blower of the embodiment.

What is claimed is:

1. A defrost-water vaporizer for a refrigerator, comprising:

a water-vaporization tray integrally formed with a pair of brackets and for collecting and containing defrost-water, the brackets being set up on both opposite sides of the tray in an upper direction;

a defrost-water absorption means disposed between and supported by the pair of brackets and for absorbing and moving the defrost-water;

a blow-off means for generating blowing air to be sent to the defrost-water absorption means by way of rotating force obtained from an electric power supplied from outside; and a driving force transmission means for transmitting the rotating force to the defrost-water absorption means to thereby move the absorbed defrost-water, including:

a motor operating by external electric power;

a rotating shaft rotating according to a rotation of the motor;

a driving pulley for transmitting the rotating force of the rotating shaft;

a driven pulley for receiving the rotating force of the rotating shaft;

a pulley belt for transmitting the rotating force of the driving pulley to the driven pulley by connecting the driving pulley and the driven pulley;

a gear shaft axially connected with the driven pulley;

a driving gear disposed at an end of the driving gear and for rotating according to the rotation of the driven pulley; and a driven gear for transmitting the rotation of the driving gear to the defrost-water absorption means after having transformed the rotation of the driving gear in a right angle direction, the driven gear being connected to the lower roller shaft.

2. The defrost-water vaporizer as claimed in claim 1, wherein the defrost-water absorption means includes a first roller rotatably connected through a lower roller shaft between the pair of brackets and rotating according to a rotation of the driving force transmission means;

a second roller rotatably connected between both upper parts of the pair of brackets; and a vaporization belt rolling around the first roller and the second roller to rotate the second roller according to the first roller being rotated, and for absorbing and moving the defrost-water according to the rotation of the rollers.

3. The defrost-water vaporizer as claimed in claim 2, wherein the vaporization belt is made of a material with a high absorption factor.

4. The defrost-water vaporizer as claimed in claim 1, wherein a diameter of the driving pulley is smaller than that of the driven pulley so as to reduce the rotating speed of the driving pulley.

* * * * *